US005490567A

United States Patent [19]

Speer

[11] Patent Number: 5,490,567

[45] Date of Patent: Feb. 13, 1996

[54] FIRE EXTINGUISHING BLANKET

[75] Inventor: Richard A. Speer, Shaker Heights, Ohio

[73] Assignee: Ohio Fire Absorbent, Inc., Shaker Heights, Ohio

[21] Appl. No.: 264,561

[22] Filed: Jun. 23, 1994

[51] Int. Cl.[6] ..... A62C 8/06

[52] U.S. Cl. ..... 169/50

[58] Field of Search ..... 169/50, 49, 65; 428/68, 74, 920

[56] References Cited

U.S. PATENT DOCUMENTS

| | | | |
|---|---|---|---|
| 1,890,906 | 12/1932 | Harney | 428/920 |
| 2,720,269 | 10/1955 | Diacos | 169/50 |
| 3,782,475 | 1/1974 | Schmidt | 169/50 |
| 4,597,450 | 7/1986 | Budmiger | 169/50 |
| 4,619,553 | 10/1986 | Fischer | 428/920 |
| 4,666,763 | 5/1987 | King et al. | 428/920 |
| 4,956,218 | 9/1990 | Haining | 169/50 |
| 5,083,617 | 1/1992 | Pierce et al. | 169/50 |

*Primary Examiner*—David M. Mitchell
*Assistant Examiner*—Gary C. Hoge
*Attorney, Agent, or Firm*—Cowan, Liebowitz & Latman

[57] ABSTRACT

A fire extinguishing blanket formed of a porous, fire resistant fabric covering surrounding a cellulosic sorbent layer is provided. The fire extinguishing blanket is well suited for extinguishing a grease fire as the fabric covering smothers the fire and the sorbent material absorbs the grease. The covering and any stitching to secure it are formed of fire resistant aramid materials which will not ignite at the temperature of a grease fire. The sorbent is selected to be one which will not melt at the temperature of a grease fire.

8 Claims, 1 Drawing Sheet

FIG. 1
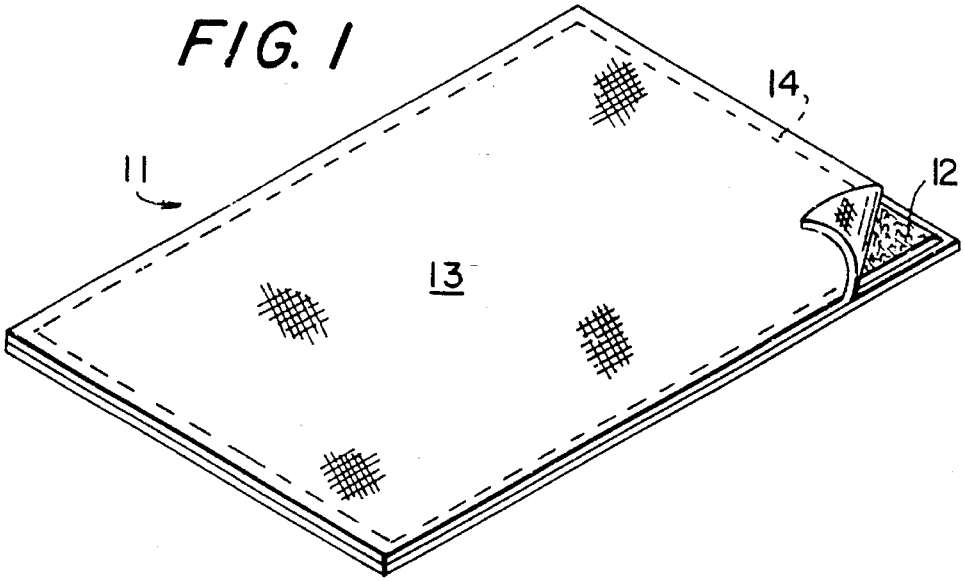
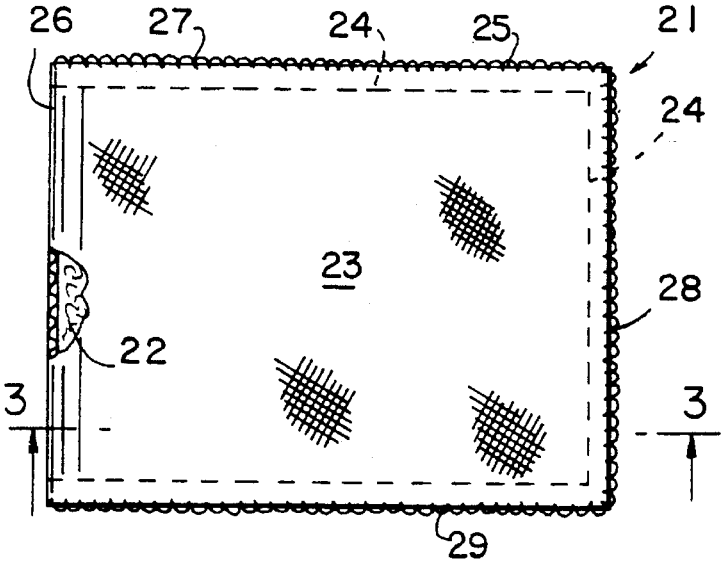
FIG. 2
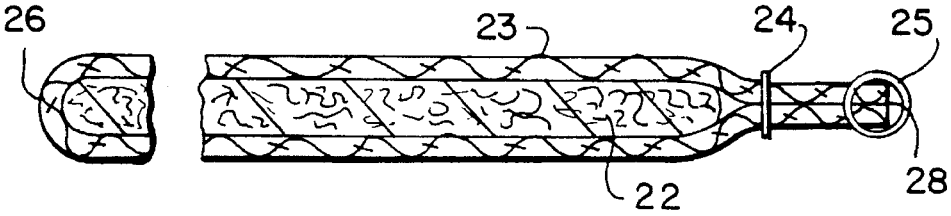
FIG. 3

FIRE EXTINGUISHING BLANKET

BACKGROUND OF THE INVENTION

This invention relates to a fire extinguishing device, and more particularly to a fire proof or fire resistant blanket used to smother a grease fire and to absorb the grease which is the fuel for the fire. The fire extinguishing blanket is uniquely well suited for extinguishing small fires, such as grease fires in skillets or other utensils used in home and restaurant kitchens.

A wide variety of fire extinguishing blankets are known in the prior art. These include blankets having a fabric layer soaked with water and having an aluminum layer as in Pierce, Jr. U.S. Pat. No. 5,083,617 for smothering the fire. U.S. Pat. No. 4,597,450 to Budmiger shows an unfolding glass thread fabric cover with handles. Other patents disclose devices which deliver a fire extinguishing material to the fire, include a nonwoven polyester sheet impregnated with a hydrous gel as in U.S. Pat. No. 4,624,320 to Romaine.

U.S. Pat. No. 5,032,446 to Sayles shows a fire extinguishing chemical sealed in pockets between two layers. Knecht, in U.S. Pat. No. 4,265,317 smothers a fire with flame smothering or inhibiting additives such as an antimony compound between a double foil layer of polyethylene or polypropylene.

The prior art also teaches various types of sorbents for absorbing grease or oil in industrial settings. These are formed of a layer of polypropylene covered by an outer covering of porous polypropylene or Kevlar®. However, use of polypropylene as a sorbent for extinguishing a grease fire is inadequate. While such a blanket will not burn due to a Kevlar® fabric layer, the inner polypropylene layer will melt at temperatures of a grease fire.

There are many disadvantages of using a conventional household chemical fire extinguisher to extinguish a stovetop grease fire. They are bulky, expensive to purchase and recharge after use and difficult to manipulate and operate. Additionally, discharge of a chemical extinguishing agent to extinguish a fire on a stovetop is messy and may spoil other food in the area. If used incorrectly, a conventional fire extinguisher will make matters worse by allowing the fire to spread.

Accordingly, it is desirable to provide an improved device for extinguishing a grease fire which is easy to use and does not suffer from the drawbacks of the prior art devices.

SUMMARY OF THE INVENTION

Generally speaking, in accordance with the invention, a fire extinguishing blanket having an inner layer of a flexible sorbent material which absorbs grease and will not burn or melt at the temperature of a grease fire, surrounded by a fire resistant porous outer layer for enclosing the inner layer is provided. When in use, grease which fuels the fire penetrates through the porous outer layer to the inner sorbent layer where it is absorbed, thus depriving the fire of its fuel. When the blanket is placed or thrown over the flames of a burning grease fire in such a way that it covers the fire, it smothers the fire by depriving it of oxygen. At the same time grease soaks through the porous outer layer and is absorbed by the inner sorbent layer of the blanket thereby depriving the fire of its fuel and preventing the fire from re-igniting.

The blanket is formed of materials having high melting points so that the blanket will not melt or burn at grease fire temperatures. The inner layer of the fire blanket is fire retardant and may be a textile mat which is inherently fire retardant or may be coated or treated with phosphorus-containing materials as conventionally practiced to attain this property. The outer covering layer is any textile material which will not burn or melt at the temperature of a grease fire, such as an aramid which is inherently fire resistant or fire proof. The available commercial aramid materials for the outer layer are Kevlar® and Nomex®, both by DuPont®. Any stitching required to secure the outer covering about the sorbent will also be of the same or a mixed type of such yarn.

Accordingly, it is an object of the invention to provide an improved fire extinguishing device for extinguishing a grease fire.

A further object of the invention is to provide a handy, lightweight, easy to manipulate and use, fire extinguishing blanket which is intended to be used in extinguishing burning grease fires.

Another object of the invention is to provide a fire extinguishing blanket which will absorb the grease of a grease fire thereby depleting the fuel feeding the fire at the same time as the blanket smothers the fire by cutting off the oxygen supply to the fire.

A further object of the invention is to provide a disposable, fire extinguishing blanket which is ready to use without prior preparation, and may be conveniently stored or hung up in areas where small, grease fires are likely to occur.

Yet another object of the invention is to provide a device which can extinguish a stovetop grease fire without making a mess or spoiling other food in the vicinity and which can be conveniently and compactly stored and accessed without requiring special handling or containers or wasting valuable time.

Still other objects and advantages of the invention as will appear hereinafter are achieved, briefly speaking, in accordance with the invention with reference to the following detailed description and the accompanying drawings.

BRIEF DESCRIPTION OF THE DRAWINGS

For a fuller understanding of the invention, reference is had to the following description taken in connection with the accompanying drawings, in which:

FIG. 1 is a perspective view of a fire extinguishing blanket of the present invention with one corner of the cover folded back to expose the inner sorbent layer;

FIG. 2 is a top plan view of a blanket wherein the covering is folded in accordance with an embodiment of the invention; and FIG. 3 is a side, cross-sectional, partial view showing the preferred layered nature of the construction of the blanket of FIG. 2 alone line 3—3, including the stitching of the fabric textile mat of the inner layer and the fire resistant outer layer.

DESCRIPTION OF THE PREFERRED EMBODIMENTS

A fire extinguishing blanket in FIG. 1, shown generally as 11 constructed and arranged in accordance with the invention, includes an inner layer 12 of a sorbent material surrounded by a covering 13 of a fire resistant fabric which is stitched at 14 to enclose sorbent 12 fully. Blanket 11 is particularly useful in home or restaurant kitchens, but may of course be stored or hung anywhere in the vicinity of a potential source of fire, such as at barbecues, in automobiles for extinguishing small carburetor fires and in workshops.

Inner layer 12 is a sorbent material which is fire retardant, flexible and will absorb grease and oil. A particularly suitable sorbent is a textile fiber mat selected from any material which will absorb oil and grease and which has a sufficiently high melting point such that it does not melt at the temperature of a grease fire. Examples of suitable sorbent materials are industrial rags and cellulosic materials, such as natural textile fibers.

A textile fiber mat of inner layer 12 generally absorbs at least about ten times its weight of grease. The textile mat may include fire-retardant industrial rags, or it may be a combustible material impregnated with a fire retarding agent or covered with a layer of a fire-retardant agent, such as antimony compounds, which are known to reduce the combustibility of textile materials. A wide variety of flame retardants for textile are set forth in *Encyclopedia of Textiles, Fibers, and Nonwoven Fabrics,* p. 188 et seq. (John Wiley & Sons, Inc., Ed. 1984) which is incorporated herein by reference. Additionally, depending on the choice of the fire-retarding agent used, the textile in question may be treated in a conventional manner to be self-extinguishable if ignited. The textile mat of inner layer 12 is selected so that it will not melt or ignite and become consumed by the fire. Suitable sorbent materials are those which can withstand the temperature of a grease fire due to its fire retardancy and its high melting point such that it will not ignite at the temperature of a grease fire during the brief exposure time to the fire before the fire is extinguished.

Disposed in surrounding relationship about inner sorbent layer 12 is a porous outer layer 13 which is fire resistant, flame-smothering and flexible. Outer layer 13 permits grease to penetrate to inner sorbent layer 12 where it is absorbed. Outer layer 13 of blanket 11 may be of any of a number of fire resistant, smothering materials known in the art. By fire resistant is meant that the materials are not combustible or are self-extinguishing. Preferably, outer layer 13 of blanket 11 is a fiber or textile material, such as an aramid. Examples include more particularly woven or non-woven fabric of the commercially available aramids, such as Kevlar® or Nomex®. These can be pure materials or mixtures. Such aramid yarns have high melting points so that they will not ignite or melt at the temperature of a grease fire (typically about 320° C.). Kevlar® melts at over 500° C.

During use, hot oil penetrates the porous fire-resistant surface of outer layer 13 to inner fabric layer 12 of blanket 11. A single layer of Kevlar® or Nomex® is sufficient to provide fire resistance to the blanket of the invention; however, the outer layer may have any convenient thickness which permits grease to penetrate. Multiple layers of Kevlar® may be provided so long as the outer layer is not so thick that porosity is affected.

Outer layer 13 may be attached to the inner layer by any suitable means, such as for instance by merely sewing the peripheral edges of outer layer 13 together, as shown by seam 14 in any convenient fashion. As shown in FIG. 1 all four sides of blanket 11 may be stitched along seam 14 at the peripheral edges. Alternatively, as shown in FIG. 2, an outer layer 23 may be folded over an inner sorbent layer 12 along a fold line 26 on one side and the adjacent peripheral edges 27, 28 and 29 stitched by stitch line 24 and edged stitched at 25 to secure outer layer 23 about inner fabric layer 22. In a further alternative embodiment, layer 23 may be folded in half, stitched at two sides and turned inside out to create a pocket. Inner sorbent layer is inserted into the pocket and outer layer 23 is then finally closed by a single or double stitch line as in the embodiments of FIGS. 1 and 2. Stitching is accomplished using a fire resistant yarn, such as Nomex® thread or other suitable substitute.

In use, fire extinguishing blanket 11 or 21 is preferably held by the user grasping opposite peripheral edges 26 and 28 or edges 27 and 29. The user approaches the fire with blanket 11 held in front to protect the user from the fire. In the case of a burning grease fire in a kitchen cooking utensil such as a skillet, blanket 11 is preferably oriented so that it is positioned or thrown over the flames to cover the utensil completely. Blanket 11 or 21 has sufficient thickness so that once positioned over the flames it has enough weight and rigidity that it does not flop around allowing oxygen to reach the burning grease, but rather covers the fire completely so as to smother it.

The heated oil or grease which is burning penetrates through porous outer layer 13 to inner layer 12 where it is absorbed, thus depriving the fire of its fuel. By reason of the weight, melting point and composition of the material of outer layer 13, it forms an oxygen-excluding, fire extinguishing barrier which smothers the burning fire. Absorption of the oil by inner layer 12 prevents re-ignition of the fire, as the pot or skillet still retains much heat. After use, blanket 11 which is saturated with oil may be discarded.

A fire extinguishing blanket 11 constructed and arranged in accordance with the invention is dimensioned so as to cover most stove-top cooking utensils used in a home or in a restaurant. Advantageously, blanket 11 is sized so that a user may apply it to the flames of a grease fire without fear of self-injury. A preferred size is about 18 inches square for home use and the same or somewhat larger for commercial applications. Blanket 11 has a thickness of between about ¼ inch to 1 inch, but this is not a critical dimension. Outer layer 13 of fire extinguishing blanket 11 may be brightly colored so it is easily visible. As the blanket is fabricated of flexible materials, it is easily folded, hung or rolled up for storage.

It will be understood that the invention is not limited to the embodiments described and the drawings are for purposes of illustration only and are not intended as a definition of the limits of the invention. Similar reference numerals refer to similar elements throughout the several views.

EXAMPLE

Fire sorbent blankets having an inner mat dimension of 18" ×18"×⅜" were fabricated as shown in FIG. 2. The outer cover 23 was Kevlar and the inner sorbent layer 22 was industrial rags impregnated with a fire retardant. The dimension of blanket 21 was selected so that the inner sorbent layer 22 absorbed about 0.35 gallon of cooking oil.

The blankets were tested on three types of fires by United States Testing Company, Inc. The three types of fires were a home frying pan type of grease fire, a home French fryer type of fire, and a restaurant grill type of fire.

The tests were conducted in a burn room with a video camera set up to records the fires.

Frying Pan

A home frying pan was used for the frying pan type of fire. The frying pan was filled with approximately ½ inch of cooking oil which was heated and then set on fire with a propane torch.

French Fryer

A small home French fryer was used for the French fryer type of fire. The French fryer was filled with approximately 3 inches of cooking oil which was heated and then set on fire using a propane torch.

Restaurant Grill

A cookie sheet on a hot plate was used to simulate the restaurant grill type of fire. The cookie sheet was filled with approximately ¼ inch of cooking oil which was heated and then set on fire using a propane torch.

The blankets were able to put out all three types of fires.

While the invention has been described in connection with the preferred embodiments, this is not meant to be limiting, and other variations will be evident to those skilled in the art and are deemed to be within the scope of the invention.

It will thus be seen that the objects set forth above, among those made apparent from the preceding description, are efficiently attained and, since certain changes may be made in carrying out the above method and in the construction(s) set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Particularly it is to be understood that in said claims, ingredients or compounds recited in the singular are intended to include compatible mixtures of such ingredients wherever the sense permits.

I claim:

1. A fire extinguishing blanket for smothering a grease fire and absorbing the burning grease which is the cause of the fire, comprising:

an inner layer including a textile sorbent material which will absorb grease and oil, said material having a melting point greater than about 320° C. so that it does not melt at the temperature of the grease fire, and a fire resistant, porous outer layer disposed about the inner layer, said outer layer being of a material which will not ignite or melt at the temperature of a grease fire and being sufficiently porous to permit grease to penetrate through to said inner layer where it is absorbed, wherein when said blanket is positioned over a burning grease fire to cover the fire, said grease penetrates through said outer layer and is absorbed by said inner layer thereby depriving the fire of its fuel, and said outer layer forms an oxygen-excluding barrier which smothers the burning fire.

2. The blanket of claim 1 wherein said outer layer disposed about said inner layer comprises two cooperating pieces larger in size than said inner layer so as to enclose completely said inner layer, said pieces stitched together along their peripheral edges.

3. The blanket of claim 1, wherein said outer layer comprises a single piece which is folded about a fold line and stitched about the open peripheral edges so as to enclose completely said inner layer.

4. The blanket of claim 2, wherein said outer layer pieces are stitched together using an aramid thread.

5. The blanket of claim 1, wherein said outer layer is formed of an aramid material.

6. The blanket of claim 1, wherein said inner sorbent layer is selected from any fiber that will absorb about ten time its weight of grease.

7. The blanket of claim 1 wherein said inner sorbent material is a cellulosic material.

8. A method of extinguishing a grease fire and preventing re-ignition by covering the burning fire with a fire extinguishing blanket formed of an inner layer of a textile sorbent material surrounded by a porous fire resistant sheet material, passing the grease through the outer porous sheet material and absorbing said grease by the inner sorbent layer to remove the grease as the fire resistant sheet material smothers the fire.

* * * * *